US008779690B2

(12) United States Patent
Tsai et al.

(10) Patent No.: US 8,779,690 B2
(45) Date of Patent: Jul. 15, 2014

(54) DIRECT CURRENT LIGHT EMITTING DEVICE CONTROL CIRCUIT WITH DIMMING FUNCTION AND METHOD THEREOF

(75) Inventors: Fu-Sheng Tsai, Zhongli (TW); Pei-Cheng Huang, Taipei (TW)

(73) Assignee: Richtek Technology Corporation, R.O.C., Chupei, Hsin-Chu (TW)

( * ) Notice: Subject to any disclaimer, the term of this patent is extended or adjusted under 35 U.S.C. 154(b) by 428 days.

(21) Appl. No.: 13/134,995

(22) Filed: Jun. 22, 2011

(65) Prior Publication Data

US 2012/0062136 A1 Mar. 15, 2012

(30) Foreign Application Priority Data

Sep. 13, 2010 (TW) ..... 99130931 A

(51) Int. Cl.
*G05F 1/00* (2006.01)

(52) U.S. Cl.
USPC ..... 315/307

(58) Field of Classification Search
CPC ..... H05B 33/0815; H05B 33/0824; H05B 33/0851; H05B 33/0818; Y02B 20/346
USPC ..... 315/307–311
See application file for complete search history.

(56) References Cited

U.S. PATENT DOCUMENTS 5,914,572 A * 6/1999 Qian et al. ..... 315/307
2010/0013409 A1* 1/2010 Quek et al. ..... 315/294

* cited by examiner

*Primary Examiner* — Thienvu Tran
(74) *Attorney, Agent, or Firm* — Tung & Associates

(57) ABSTRACT

The present invention discloses a direct current (DC) light emitting device control circuit with dimming function, and a method thereof, wherein the dimming function is provided in a feedback loop for feeding back a feedback signal from an output terminal to a power switch control circuit; the feedback signal relates to an output current supplied to the DC light emitting device. The present invention adjusts the feedback signal according to the desired brightness of the DC light emitting device. The present invention controls a power switch according to the adjusted feedback signal, such that the output current supplied to the DC light emitting device is adjusted, and accordingly the brightness of the DC light emitting device is adjusted below the full brightness.

7 Claims, 8 Drawing Sheets

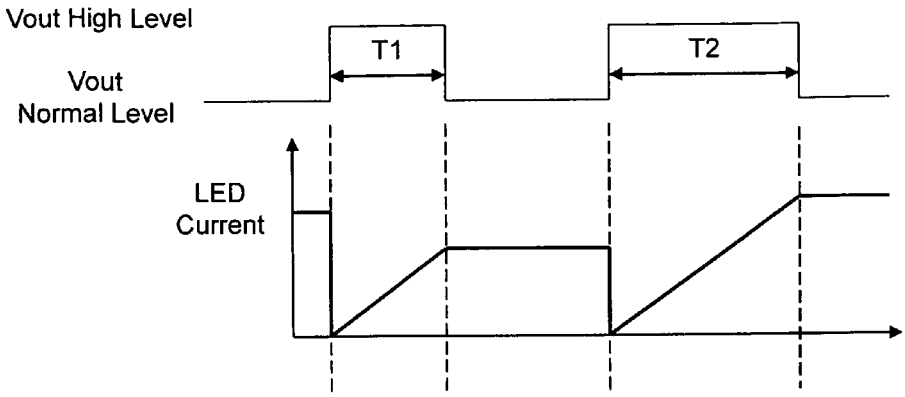
Fig. 11A
Fig. 11B
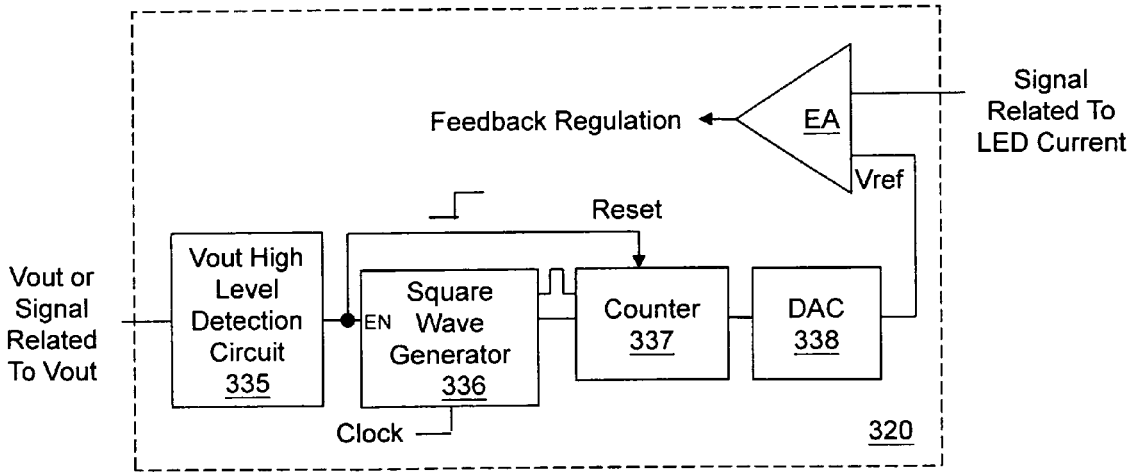
Fig. 11C

DIRECT CURRENT LIGHT EMITTING DEVICE CONTROL CIRCUIT WITH DIMMING FUNCTION AND METHOD THEREOF

CROSS REFERENCE

The present invention claims priority to TW 099130931, filed on Sep. 13, 2010.

BACKGROUND OF THE INVENTION

1. Field of Invention

The present invention relates to a direct current light emitting device control circuit with a dimming function and a method thereof, in particular to such direct current light emitting device control circuit with a dimming function which has a better power factor because it does not need to use a tri-electro AC switch (hereinafter referred to as the "TRIAC device"), and a method thereof.

2. Description of Related Art

LEDs (light emitting diodes) are one typical type of direct current light emitting devices. Referring to FIG. 1, in prior art, to drive the LEDs from an AC power source, the AC power is first rectified by a bridge rectifier 4, and the rectified AC power is converted to a DC voltage by an AC-DC power regulator 10; next, an LED driver circuit 20 operates according to the DC voltage to control the currents of the LEDs. The AC-DC power regulator 10 includes a primary side circuit 11, a secondary side circuit 12, a transformer 13, and other discrete devices such as capacitors and diodes (not shown). The secondary side circuit 12 detects the output voltage and the detection result is fed back to the switch control circuit PWM in the primary side circuit 11 by opto-coupling, to control the operation of the power switch P of the primary side circuit 11.

The drawback of the foregoing prior art is that it requires the AC-DC power regulator 10 to generate a regulated voltage, and the LED driver circuit 20 to control the currents of the LEDs according to the voltage, so at least three integrated circuit (IC) chips are needed: the primary side circuit 11, the secondary side circuit 12, and the LED driver circuit 20; the cost is high for such an arrangement.

In addition, as an AC power source is used, if it is required to adjust the brightness (i.e., dimming) of the light emitting devices, the prior art usually utilizes a tri-electro AC switch (TRIAC) device 2 as shown in FIG. 2 to extract the turn-ON angle of the inputted AC power, so as to adjust the output power for achieving the dimming function. However, one major disadvantage of using the TRIAC device is that it degrades the power factor because it changes the turn-ON angle.

In view of above, the present invention overcomes the foregoing drawbacks by putting forth a direct current light emitting device control circuit with a dimming function and a corresponding method, which utilize a novel dimming control mechanism rather than a TRIAC device, so that the power factor is better and the power consumption is reduced.

SUMMARY OF THE INVENTION

An objective of the present invention is to provide a direct current light emitting device control circuit with a dimming function.

An objective of the present invention is to provide a control method for dimming a direct current light emitting device.

To achieve the foregoing objective, the present invention provides a direct current light emitting device control circuit with a dimming function, comprising: at least one power switch; a switch control circuit controlling the power switch to convert an input voltage to an output current which is supplied to at least one direct current light emitting device; a feedback circuit generating a feedback signal according to a signal related to the output current; and a dimming circuit coupled to the feedback circuit, the dimming circuit adjusting the feedback signal to generate an adjusted feedback signal, wherein the switch control circuit receives the adjusted feedback signal and controls the power switch according to the adjusted feedback signal whereby the output current supplied to the direct current light emitting device is adjusted to achieve the dimming function.

In the foregoing direct current light emitting device control circuit, the dimming circuit includes a variable resister connected to the feedback circuit in series or in parallel; or includes an adjustable gain amplifier having an input coupled to the feedback signal and an output coupled to the switch control circuit; further includes a parallel circuit coupled to an output terminal of the feedback circuit, the parallel circuit includes a switch, and the feedback signal is adjusted by turning on or off the switch.

In another aspect, the present invention provides a control method for dimming a direct current light emitting device, comprising: controlling at least one power switch to convert an input voltage to an output current which is supplied to at least one direct current light emitting device; generating a feedback signal according to a signal related to the output current; adjusting the feedback signal to generate an adjusted feedback signal according to a brightness of the direct current light emitting device which is below full brightness; and controlling the power switch according to the adjusted feedback signal such that the output current supplied to the direct current light emitting device is adjusted, whereby the brightness of the direct current light emitting device is controllable below full brightness to achieve the dimming function.

In the foregoing dimming control method, the power switch also converts the input voltage to an output voltage; in a kind of embodiments, the level of the output voltage is changed by adjusting the feedback signal, and the output current supplied to the direct current light emitting device is adjusted to achieve the dimming function. If the signal related to the output current is compared with a reference signal to generate the feedback signal, the feedback signal is adjusted according the change in the level of the output voltage.

For example, in one embodiment, the level of the output voltage periodically varies between a high level and a low level and a duty ratio of each period determines the output current supplied to the direct current light emitting device.

For example, in one embodiment, the level of the output voltage is at a normal level in a steady status, but the output voltage is raised to a level higher than the normal level when the feedback signal is adjusted, and a difference between the higher level and the normal level determines the output current supplied to the direct current light emitting device.

For example, in one embodiment, the level of the output voltage is at a medium level in a steady status, but the output voltage is raised to a high level to generate a positive pulse or the output voltage is lowered to a low level to generate a negative pulse when the feedback signal is adjusted, and the step of adjusting the output current supplied to the direct current light emitting device according to the change in the level of the output voltage includes: upward adjusting the output current supplied to the direct current light emitting device one level according to the positive pulse or downward adjusting the output current supplied to the direct current light emitting device one level according to the negative pulse.

The objectives, technical details, features, and effects of the present invention will be better understood with regard to the detailed description of the embodiments below, with reference to the drawings.

BRIEF DESCRIPTION OF THE DRAWINGS

FIGS. 11A-11B show another embodiment of the present invention, illustrating another method of dimming brightness according to a feedback signal.

FIG. 11C shows a hardware embodiment of the present invention, illustrating a circuit fulfilling the dimming method in FIGS. 11A-11B.

DESCRIPTION OF THE PREFERRED EMBODIMENTS

The present invention is applicable to any DC controlled light emitting devices, not limited to LEDs. However, because the LEDs are the most common light emitting devices, the following embodiments are illustrated by using LEDs as examples.

Figure 1:
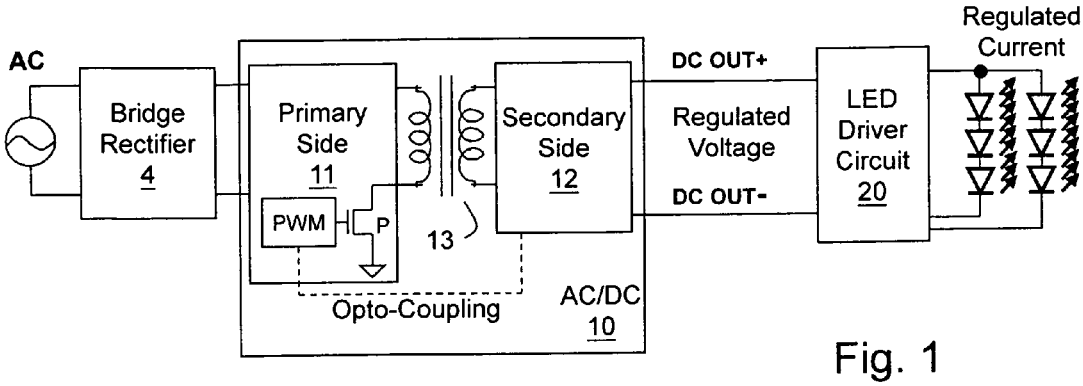
Fig. 1 (Prior Art)
FIG. 1 shows a schematic diagram of a prior art arrangement utilizing an AC-DC power regulator 10 to convert an AC voltage to a DC voltage and an LED driver circuit 20 to control power supplied to LEDs.
Figure 2:
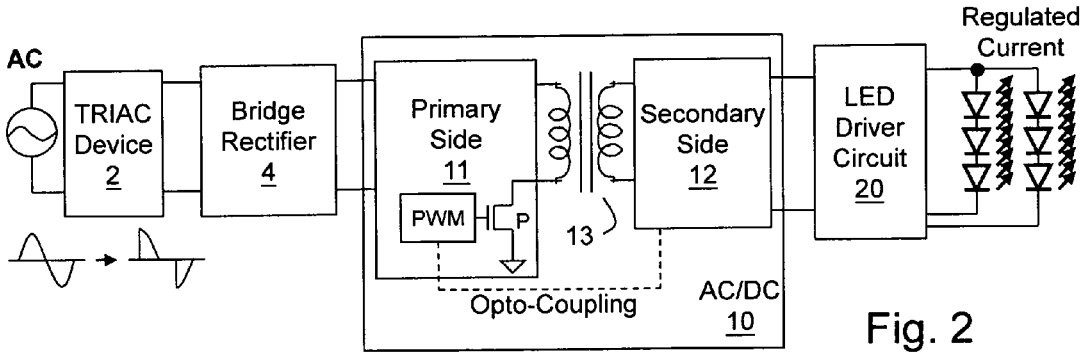
Fig. 2 (Prior Art)
FIG. 2 shows a schematic diagram of a prior art arrangement utilizing a TRIAC device 2 for dimming control.
Figure 3:
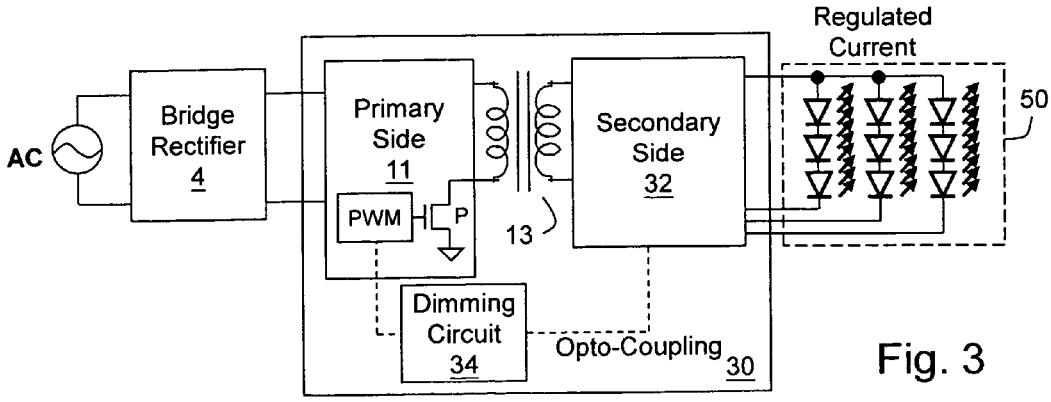
FIG. 3 shows an embodiment of the present invention.

FIG. 3 shows an embodiment of the present invention. In this embodiment it does not need to provide two IC chips of the secondary side circuit 12 and the LED driver circuit 20. As show in this figure, the light emitting device control circuit 30 of this embodiment receives an AC power rectified by a bridge rectifier 4 and generates an output current to be supplied to a load circuit 50. The load circuit 50 may be an LED circuit, but it also may be any circuit requiring a controllable current. The light emitting device control circuit 30 comprises: a primary side circuit 11 receiving a rectified AC power; a transformer 13, which is coupled to the primary side circuit 11, for converting a primary side voltage to a secondary side voltage to be supplied to the load circuit 50; a secondary side circuit 32, which is coupled to the transformer 13, for directly controlling the current of the load circuit 50, and the secondary side circuit 32 generates a feedback signal which is fed back to the primary side circuit 11 by opto-coupling; and a dimming circuit 34, which is coupled to a path transmitting the opto-coupled feedback signal to the primary side circuit 11, for adjusting the feedback signal received by the primary side circuit 11 to achieve the dimming function.

More specifically, the switch control circuit PWM of the primary side circuit 11 controls the operation of the power switch P according to the feedback signal. Therefore, by changing the feedback signal, the output current of the secondary side circuit 32 can be adjusted. For example, assuming that the feedback signal and the output current Iout are positively correlated, if the dimming circuit 34 adjusts the feedback signal to 200% of its original value, then as the original feedback signal (the input of the dimming circuit 34) reaches 50% of the regulation target value, the feedback signal (the output value of the dimming circuit 34) received by the primary side circuit 11 reaches 100% of the regulation target value, so the switch control circuit PWM will reduce the duty ratio (or by other equivalent means, depending on the control mechanism of the switch control circuit PWM) of the power switch P to adjust the brightness of the LEDs downward. The foregoing embodiment only shows one of many possible dimming methods; other embodiments include providing mechanisms inside the switch control circuit PWM to control brightness in response to the variation of the feedback signal (the details will be described later).

The detail configuration of the secondary circuit 32 will be described by way of example hereinafter. However, please note that the circuit has various equivalents and the scope of the present invention is not limited to the details of the figure.

Figure 4:
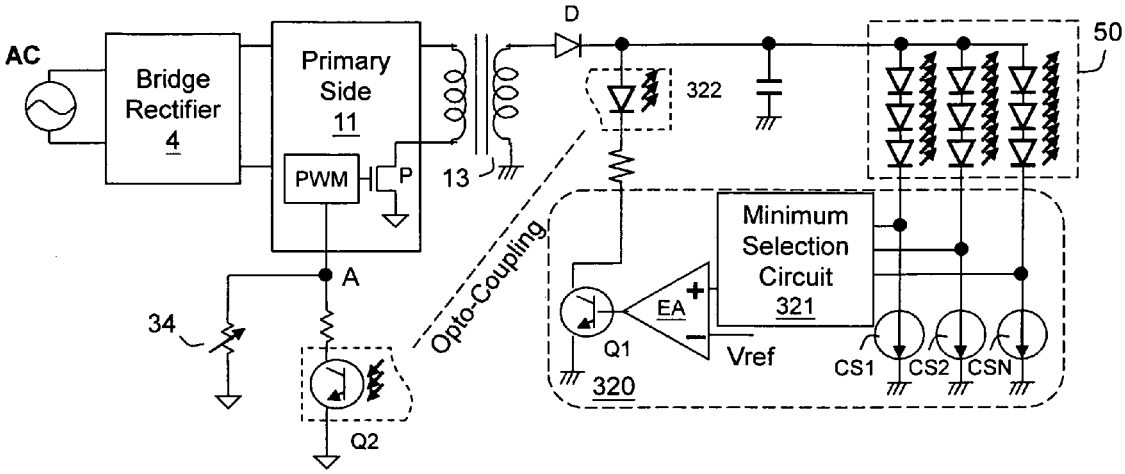
FIGS. 4 and 5 show hardware embodiments of secondary side circuits 32 and also embodiments of dimming circuits 34.

Referring to FIG. 4, in this embodiment, the secondary side circuit 32 comprises an IC 320, an opto-coupler diode 322, and a diode D. If the load circuit 50 includes multiple strings of LEDs, the IC 320 would include multiple current sources CS1-CSN to correspondingly control the current on each of the LED strings. The operation voltages of the current sources CS1-CSN must be higher than a minimum normal operation voltage. The IC 320 further includes a minimum selection circuit 321 which selects the lowest voltage among the corresponding nodes of the LED strings as the input of the error amplifier EA to be compared with a reference voltage Vref. The voltages of the foregoing corresponding nodes reflect the operation statuses of the corresponding current sources. The output of the error amplifier EA controls a transistor Q1, to thereby control a corresponding current to power the opto-coupler diode 322 to light. There are many ways to control the current through the opto-coupler diode 322 by the transistor Q1. For example, the transistor can directly form a controllable current source circuit, form a controllable current source circuit with other devices, or output a controllable voltage which is supplied to a resistor connected with it in series to control the current passing through the resistor. In the embodiment using a resistor connected with the transistor in series, the resistor can be embedded into the IC 320, or provided externally to the IC 320 so that the parameters such as the current amount can be set and adjusted from outside of the IC 320. What is shown in this is an embodiment using an external resister. The light emitted by the opto-coupler diode 322 is fed back to the phototransistor Q2 of the primary side circuit by opto-coupling, such that the switch control circuit PWM controls the operation (in general, the opto-coupler diode 322 and the phototransistor Q2 are integrated into one component referred to as an opto-coupler) of the power switch P according to the feedback signal. All of the operation voltages of the current sources CS1-CSN are accordingly higher than the minimum operation voltage through the feedback control mechanism. That is, the current sources CS1-CSN can operate normally to control the current of each LED string. In other words, the LED driver circuit 30 of the present invention directly controls the current of the load circuit 50. If the load circuit 50 includes only one path (one single LED string) rather than a parallel circuit of multiple LED strings, then the IC 320 only needs a single current source and the minimum selection circuit 321 is not necessary.

In this embodiment, the dimming circuit 34 may be a variable resistor which achieves the dimming function by adjusting the signal at the node A to change the feedback signal received by the primary side circuit 11. Please note that the variable resistor is not limited to the location shown in the figure; in other embodiments, it can be coupled between the phototransistor Q2 and the switch control circuit PWM in series, or connected in series below the phototransistor Q2, instead of connected with the phototransistor Q2 in parallel.

Figure 5:
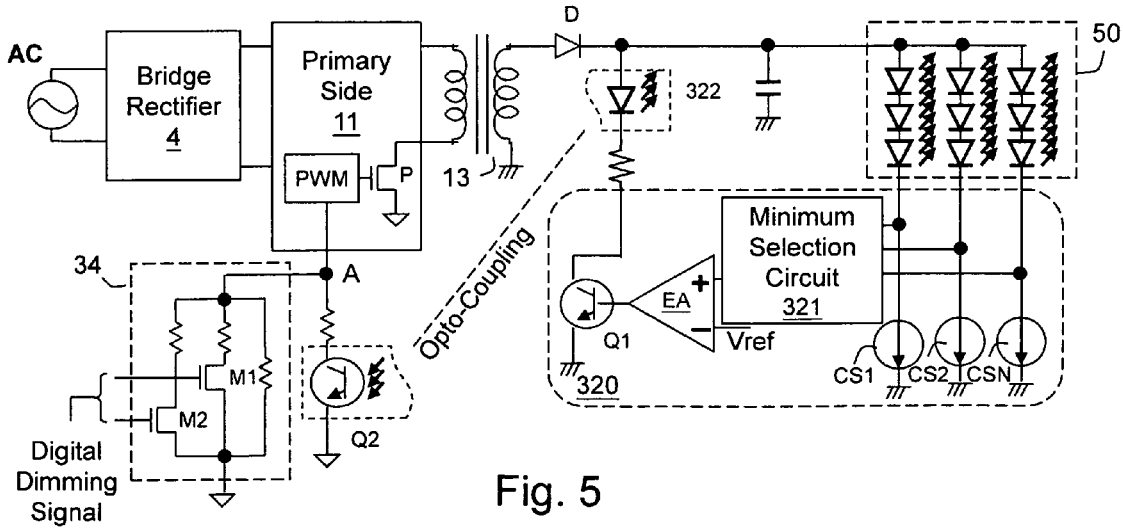

Another embodiment of the dimming circuit 34 is shown in FIG. 5. In this embodiment, the dimming circuit 34 receives a digital signal to control the transistors M1 and M2 such that the total resistance of the dimming circuit 34 is adjusted to change the value of the signal at the node A. Please note that the dimming circuit 34 of this embodiment can include only one path—the transistor switch M1 and the resistor connected to the upper end of the transistor switch M1, for example. In this case, the dimming circuit 34 for example can adopt the dimming method exemplified in FIGS. 8A-8B.

Figure 6A:
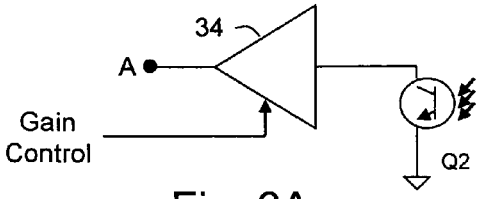
FIGS. 6A and 6B show two other embodiments of dimming circuits 34.

FIG. 6A shows another embodiment of the dimming circuit 34. The dimming circuit 34 of this embodiment may be an adjustable gain amplifier so the value of the signal at the node A can be changed by adjusting the gain of the amplifier.

Figure 6B:
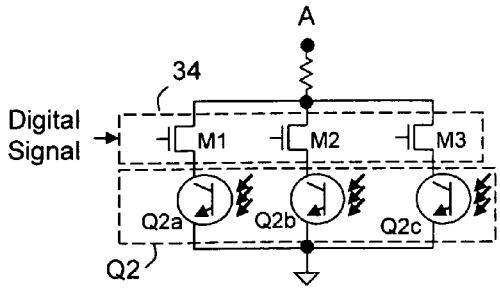
Figure 7A:
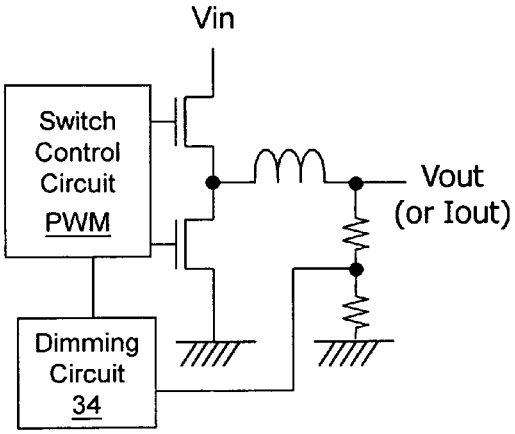
FIGS. 7A-7H show several examples of DC-DC power regulators.
Figure 7B:
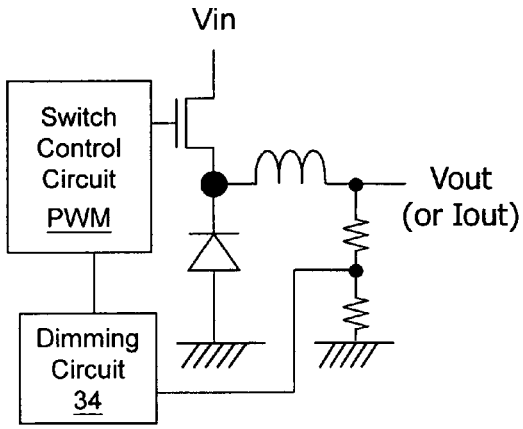
Figure 7C:
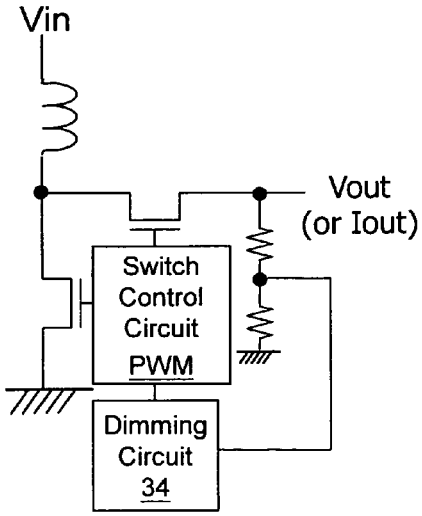
Figure 7D:
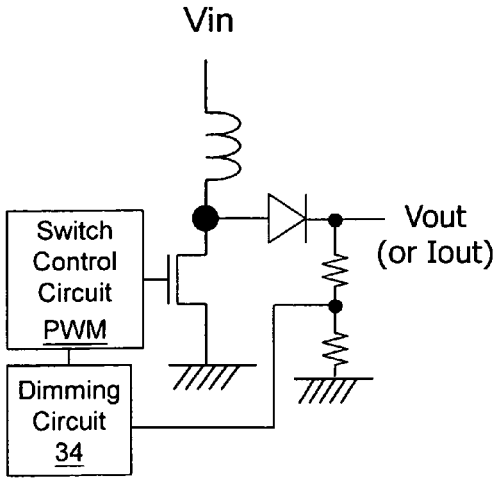
Figure 7E:
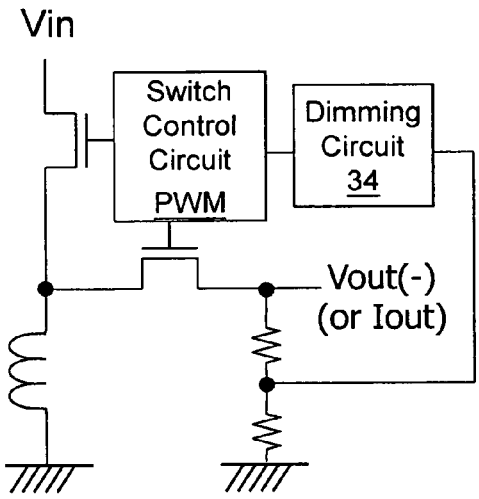
Figure 7F:
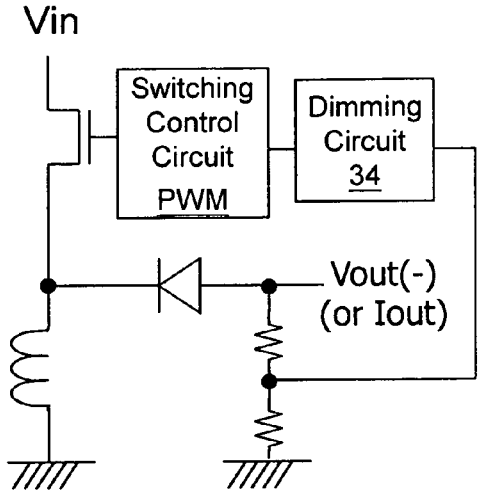
Figure 7G:
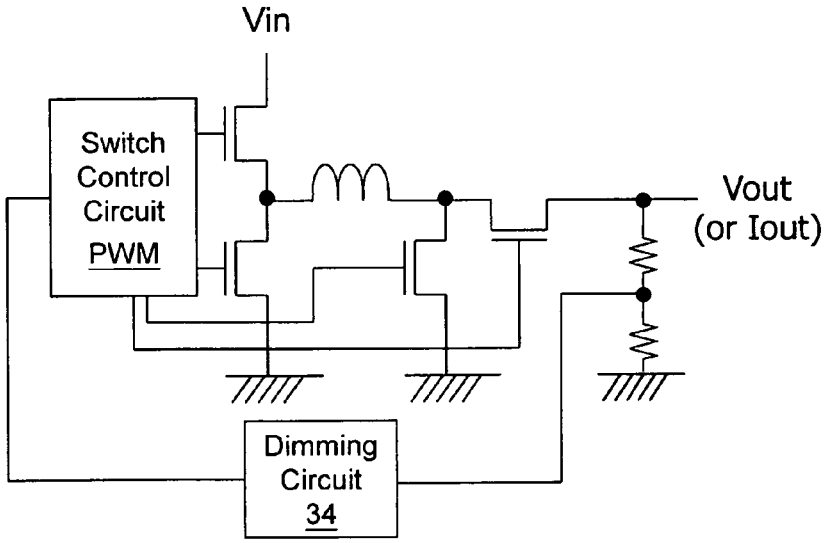
Figure 7H:
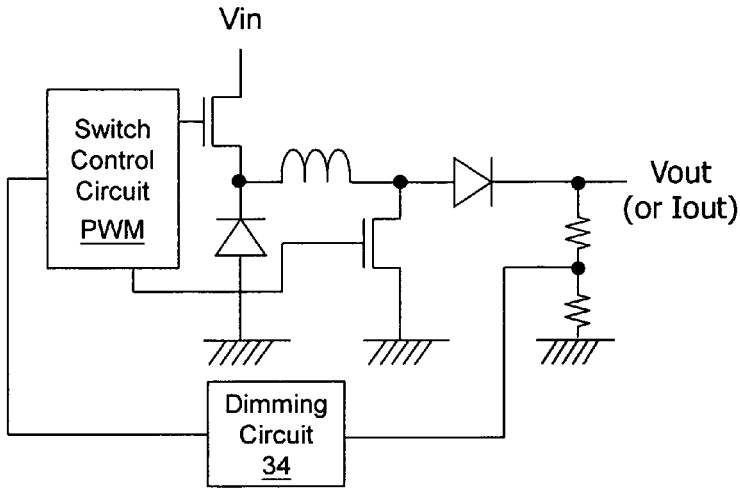

FIG. 6B shows another embodiment of the dimming circuit 34. In this embodiment, the current of the phototransistor Q2 can be controlled by the dimming circuit 34 to adjust the value of the signal at the node A. More specifically, the phototransistor Q2 shown to be one single transistor in the foregoing embodiments is replaced with a composite phototransistor Q2 including phototransistors Q2*a*-Q2*c*, and the dimming circuit 34 includes transistor switches M1-M3. By controlling the transistor switches M1-M3, the value of the signal at the node A can be changed.

There are various other methods to adjust the feedback signal; when the feedback signal is a voltage signal, basically, any methods capable of adjusting voltages can be utilized to adjust the feedback signal for dimming.

Although in the background section an AC-DC power regulator is introduced, and the description thus far describes the present invention by using an AC-DC power regulator as an example, the spirit of the present invention is not limited to the AC-DC power regulator; the same spirit, that is, to achieve the dimming function by adjusting the feedback signal, is also applicable to a DC-DC power regulator. Such DC-DC power regulator for example may be, but is not limited to, a synchronous or asynchronous power conversion circuit such as a buck converter, a boost converter, an inverting converter, or a buck-boost converter, as shown in FIGS. 7A-7H.

Figure 8A:
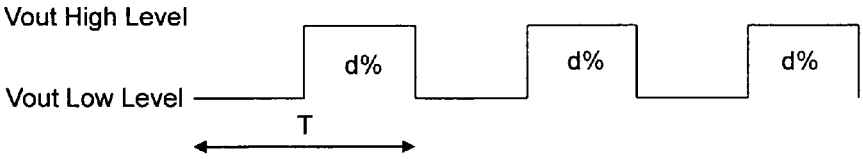
FIGS. 8A-8B show an embodiment of the present invention, illustrating a method of dimming brightness according to a feedback signal.
Figure 8B:
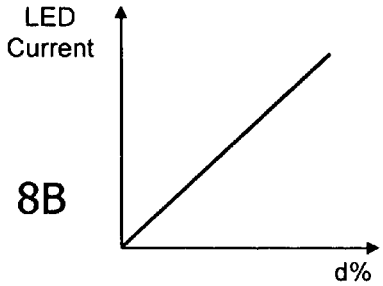

In addition to directly adjusting the value of the signal at the node A for dimming, in another embodiment, the dimming circuit 34 also can perform the so-called PWM dimming. Referring to FIGS. 8A-8B, the dimming circuit 34 can control the feedback signal to switch between two levels, and the output voltage Vout is accordingly changed between a high level and a low level. The brightness of the LEDs can be adjusted through adjusting the duty ratio d % of each period, as shown in FIG. 88. The brightness of the LEDs is determined by the high level and the low level of the output voltage Vout, in which the lowest brightness of the LEDs does not have to be zero.

Figure 9A:
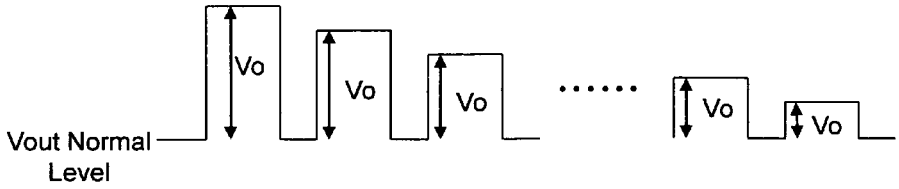
FIGS. 9A-9B show another embodiment of the present invention, illustrating another method of dimming brightness according to a feedback signal.
Figure 9B:
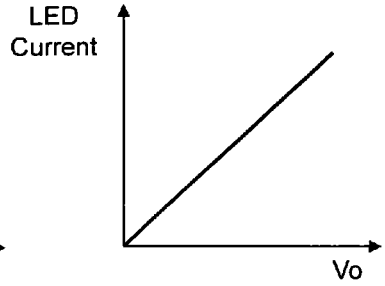
Figure 9C:
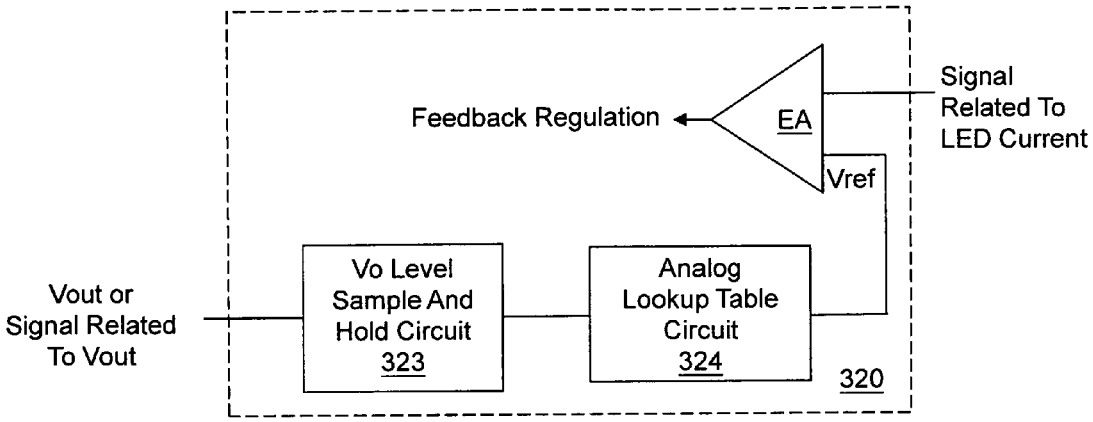
FIGS. 9C-9D show two hardware embodiments of the present invention, illustrating circuits fulfilling the dimming method in FIGS. 9A-9B.
Figure 9D:
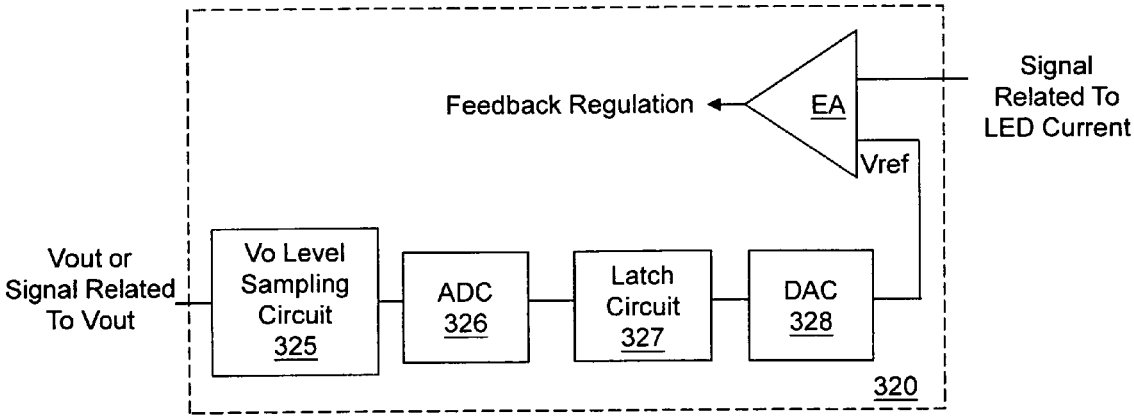

FIGS. 9A-9B shows another dimming method. In this embodiment, the output voltage Vout normally stays at a normal level instead of switching between the high level and low level as illustrated in the previous embodiment. However, when the dimming circuit 34 is dimming light, it controls the feedback signal such that the output voltage Vout is higher than the normal level. The difference Vo from the normal level determines the brightness of the LED as shown in FIG. 9B. Similar to the previous embodiment, the lowest brightness of the LED is not necessarily zero. An example to perform the dimming control of FIG. 9B by hardware is shown in FIG. 9C; please refer to FIG. 9C in conjunction with FIG. 4 (FIG. 9C omits some irrelevant circuits to simplify the drawing), a Vo level sample and hold circuit 323 can be provided in the IC 320 to sample the difference Vo. The difference Vo can be converted by an analog mapping table 324 to the reference voltage Vref, which serves as the reference input of the error amplifier EA. That is, the difference Vo determines the reference basis of the error amplifier EA. Alternatively, referring to FIG. 9D in conjunction FIG. 4, a Vo level sampling circuit 325 can be provided in the IC 320 to sample the difference Vo. Through an ADC (analog-to-digital converter) circuit 326, the difference Vo can be converted to a digital signal which is stored in a latch circuit 327. The value stored in the latch circuit 327 is converted by a DAC (digital-to-analog converter) 328 or a mapping table to the reference voltage Vref, which serves as the reference input of the error amplifier EA to determine the reference basis of the error amplifier EA.

Figure 10A:
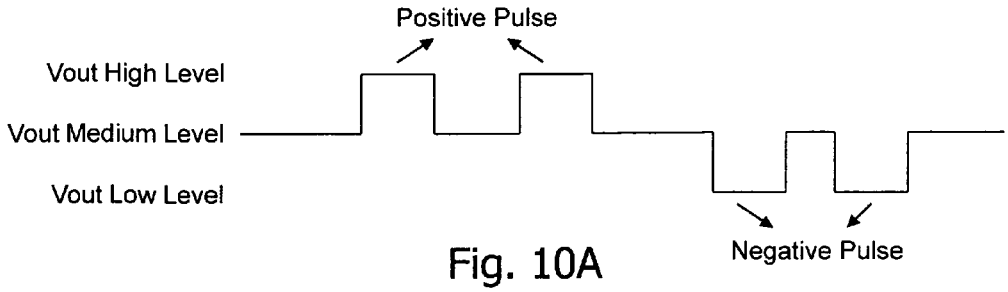
FIGS. 10A-10B show another embodiment of the present invention, illustrating another method of dimming brightness according to a feedback signal.
Figure 10B:
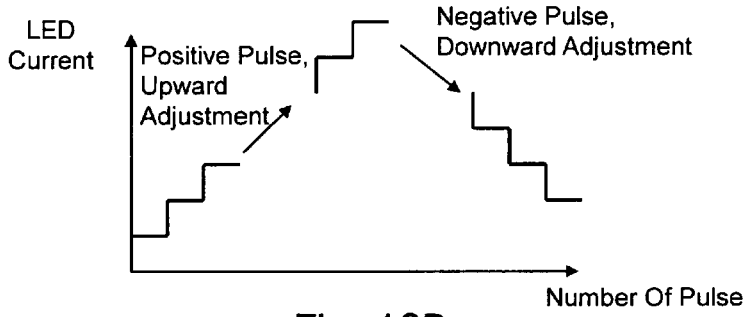
Figure 10C:
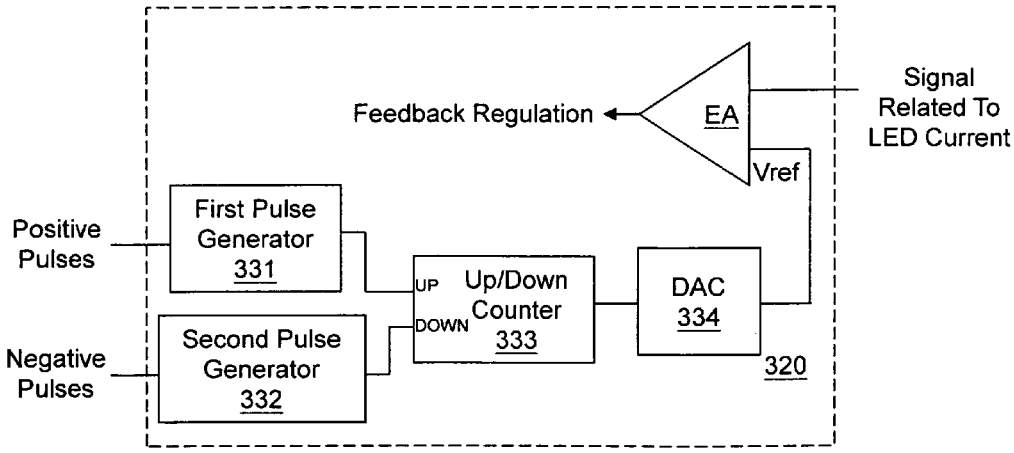
FIG. 10C shows a hardware embodiment of the present invention, illustrating a circuit fulfilling the dimming method in FIGS. 10A-10B.

FIGS. 10A-10B shows another dimming method. This embodiment uses a "pulse setting" method to diming light. More specifically, the output voltage Vout is controlled by the feedback signal to have three levels: a high level, a medium level, and a low level. When the output voltage Vout changes from the medium level to the high level to form a positive pulse, the brightness of the LEDs is adjusted upward to a next higher level; when the output voltage Vout changes from a medium level to a low level to form a negative pulse, the brightness of the LEDs is adjusted downward to a next lower level; in other cases the brightness of the LEDs keeps the same. An example to perform the dimming control of FIGS. 10A-10B by hardware is shown in FIG. 10C; please refer to FIG. 10C in conjunction with FIG. 4, a first pulse generator 331 and a second pulse generator 332 are provided in the IC 320; the first pulse generator 331 generates a one-shot pulse each time a positive pulse is received, and the second pulse generator 332 generates a one-shot pulse each time a negative pulse is received. The one-shot pulse is inputted to the up/down counter 333 to conduct an up/down count. The count value of the up/down counter 333 is converted to the reference voltage Vref through a DAC 334 or a mapping table. The reference voltage Vref is inputted to an error amplifier EA to determine the reference basis of the error amplifier EA.

FIGS. 11A-11B shows another dimming method. In this embodiment, the output voltage Vout stays at a normal level during normal operation. When the dimming circuit 34 starts to dim light, the feedback signal makes the output voltage Vout to be higher than the normal level, and the period in which the output voltage Vout is higher than the normal level determines the brightness of the LED. An example to perform the dimming control of FIG. 9B by hardware is shown in FIG. 11C; please refer to FIG. 9C in conjunction with FIG. 4. A Vout high level detection circuit 335 is provided in the IC 320. When it detects a high level, a counter 337 is reset to zero and a square wave generator 336 is enabled to generate pulses according a clock. The counter 337 counts the number of the pulses. The count value of the counter 337 is converted the reference voltage Vref through a DAC 334 or a mapping table.

The reference voltage Vref is inputted to an error amplifier EA to determine the reference basis of the error amplifier EA.

The foregoing embodiments illustrate two types of methods to dim light by the feedback signal. The first type adjusts the LED target current value according to the ratio between the original feedback signal (the original output of the feedback circuit) and the adjusted feedback signal (the feedback signal received by the switch control circuit PWM); the second type adjusts the output voltage Vout according to feedback signal, and the changes in the output voltage Vout determine the reference voltage Vref of the error amplifier EA. In addition to the above, other dimming methods can be conceived in light of the teachings by the present invention. For example, a switch can be provided on the path of each LED string, and a PWM signal is generated according to the feedback signal to control the duty of the switch, to perform PWM dimming.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, the LEDs in each of the embodiments can be white LEDs, colored LEDs, or organic LEDs. The concept of the present invention is not limited to LEDs, and it can be extended to any DC controlled light emitting devices. For another example, the secondary side circuit 32 can be embodied in various ways other than the ones shown in FIGS. 4 and 5. For a further example, the dimming circuit 34 can be disposed in the feedback loop and connected to the feedback circuit in series or in parallel, or disposed out of the feedback loop and provided as an external circuit which controls the output signal of the feedback circuit, as long as the feedback signal can be controlled. Thus, the present invention should cover all such and other modifications and variations, which should be interpreted to fall within the scope of the following claims and their equivalents.

What is claimed is:

1. A direct current light emitting device control circuit with a dimming function, comprising:

at least one power switch;

a switch control circuit controlling the power switch to convert an input voltage to an output current which is supplied to at least one direct current light emitting device;

a feedback circuit generating a feedback signal according to a signal related to the output current; and a dimming circuit coupled to the feedback circuit, the dimming circuit adjusting the feedback signal to generate an adjusted feedback signal, wherein the dimming circuit includes an adjustable gain amplifier having an input coupled to the feedback signal and an output coupled to the switch control circuit, wherein the switch control circuit receives the adjusted feedback signal and controls the power switch according to the adjusted feedback signal whereby the output current supplied to the direct current light emitting device is adjusted to achieve the dimming function.

2. The direct current light emitting device control circuit with a dimming function of claim 1, wherein the power switch is a power switch of a primary side circuit in an AC to DC converter and the feedback circuit includes a phototransistor.

3. The direct current light emitting device control circuit with a dimming function of claim 1, wherein the power switch is a power switch of a DC to DC converter.

4. A direct current light emitting device control circuit with a dimming function, comprising:

at least one power switch;

a switch control circuit controlling the power switch to convert an input voltage to an output current which is supplied to at least one direct current light emitting device;

a feedback circuit generating a feedback signal according to a signal related to the output current; and a dimming circuit coupled to the feedback circuit, the dimming circuit adjusting the feedback signal to generate an adjusted feedback signal, wherein the dimming circuit includes a parallel circuit coupled to an output terminal of the feedback circuit, the parallel circuit including a switch, and the feedback signal being adjusted by turning on or off the switch, wherein the switch control circuit receives the adjusted feedback signal and controls the power switch according to the adjusted feedback signal whereby the output current supplied to the direct current light emitting device is adjusted to achieve the dimming function.

5. The direct current light emitting device control circuit with a dimming function of claim 4, wherein the parallel circuit includes at least two parallel paths and at least one of the parallel paths includes the switch to activate or inactivate the path.

6. The direct current light emitting device control circuit with a dimming function of claim 4, wherein the power switch is a power switch of a primary side circuit in an AC to DC converter and the feedback circuit includes a phototransistor.

7. The direct current light emitting device control circuit with a dimming function of claim 4, wherein the power switch is a power switch of a DC to DC converter.

* * * * *